US006940422B1

(12) United States Patent
Bachelder et al.

(10) Patent No.: US 6,940,422 B1
(45) Date of Patent: Sep. 6, 2005

(54) EMERGENCY VEHICLE TRAFFIC SIGNAL PREEMPTION SYSTEM

(75) Inventors: Aaron D. Bachelder, Irvine, CA (US); Conrad F. Foster, Los Angeles, CA (US)

(73) Assignee: California Institute of Technology, Pasadena, CA (US)

( * ) Notice: Subject to any disclaimer, the term of this patent is extended or adjusted under 35 U.S.C. 154(b) by 0 days.

(21) Appl. No.: 10/642,435

(22) Filed: Aug. 15, 2003

Related U.S. Application Data

(60) Provisional application No. 60/403,916, filed on Aug. 15, 2002.

(51) Int. Cl.[7] ..... G08G 1/095

(52) U.S. Cl. ..... 340/906; 340/907; 340/916; 701/300

(58) Field of Search ..... 340/906, 902, 340/925, 907, 916, 917, 933, 935; 701/300, 701/302

(56) References Cited

U.S. PATENT DOCUMENTS

| | | | | |
|---|---|---|---|---|
| 4,775,865 | A * | 10/1988 | Smith et al. | 340/906 |
| 5,014,052 | A * | 5/1991 | Obeck | 340/906 |
| 5,710,555 | A * | 1/1998 | McConnell et al. | 340/916 |
| 5,889,475 | A * | 3/1999 | Klosinski et al. | 340/902 |
| 6,232,889 | B1 * | 5/2001 | Apitz et al. | 340/906 |
| 6,326,903 | B1 * | 12/2001 | Gross et al. | 340/988 |
| 6,621,420 | B1 * | 9/2003 | Poursartip | 340/907 |

OTHER PUBLICATIONS

Co-pending U.S. Appl. No. 10/704,530, filed Nov. 7, 2003, entitled Method and System for Beacon/Heading Emergency Vehicle Intersection Preemption.

Co-pending U.S. Appl. No. 10/811,075, filed Mar. 24, 2004, entitled Emergency Vehicle Traffic Signal Preemption System.

Co-pending U.S. Appl. No. 10/696,490, filed Oct. 28, 2003, entitled Method and Appratus for Alerting Civilian Motorists to the Approach of Emergency Vehicles.

Co-pending U.S. Appl. No. 10/965,408, filed Oct. 12, 2004, entitled Traffic Preemption System.

Co-pending U.S. Appl. No. 10/942,498, filed Sep. 15, 2004, entitled Forwarding System for Long-Range Preemption and Corridor Clearance for Emergency Response.

(Continued)

*Primary Examiner*—Phung T. Nguyen
(74) *Attorney, Agent, or Firm*—Christie, Parker & Hale, LLP

(57) ABSTRACT

An emergency vehicle traffic light preemption system for preemption of traffic lights at an intersection to allow safe passage of emergency vehicles. The system includes a real-time status monitor of an intersection which is relayed to a communications controller for transmission to emergency vehicles as well as to a central dispatch office. The system also provides for audio warnings at an intersection to protect pedestrians who may not be in a position to see visual warnings or for various reasons cannot hear the approach of emergency vehicles. A transponder mounted on an emergency vehicle provides autonomous control so the vehicle operator can attend to getting to an emergency and not be concerned with the operation of the system. Activation of a Code 3 situation provides communications with each intersection being approached by an emergency vehicle and indicates whether the intersection is preempted or if there is any conflict with other approaching emergency vehicles. On-board diagnostics handle various information including heading, speed, and acceleration sent to a communications controller which is transmitted to an intersection and which also simultaneously receives information regarding the status of an intersection.

17 Claims, 4 Drawing Sheets

OTHER PUBLICATIONS

Co-pending U.S. Appl. No. 10/960,129, filed Oct. 6, 2004, entitled Detection and Enforcement of Failure-to-Yield in an Emergency Vehicle Preemption System.

Co-pending U.S. Appl. No. 10/410,582, filed Apr. 8, 2003, entitled Emergency Vehicle Control System Traffic Loop Preeption.

* cited by examiner

EMERGENCY VEHICLE TRAFFIC SIGNAL PREEMPTION SYSTEM

Priority of U.S. Provisional Application Ser. No. 60/403,916 filed Aug. 15, 2002 is hereby claimed.

The invention described herein was made in the performance of work under a NASA contract and is subject to the provisions of Public Law 96-517 (35 U.S.C. 202) in which the Contractor has elected to retain title.

BACKGROUND OF THE INVENTION

1. Field of the Invention

This invention relates to systems for controlling vehicle traffic signals to allow safe passage of emergency vehicles and more particularly relates to a system for autonomously preempting traffic signals at an intersection that includes a transponder, a real-time intersection monitor, and an audio alarm or warning system.

2. Background Information

Present systems used to preempt traffic signals and clear intersections for emergency vehicles responding to a life-saving event rely on: sound activation, optical activation, direct microwave activation, and a combination of all the above. All of these systems have severe operational limitations affected by weather, line of sight, and critical range. These systems have further drawbacks requiring them to be activated by the emergency vehicle operator. None of these known systems provide real-time monitoring of intersection phases which has the added affect that an operator does not get the feedback desired and soon stops using the system.

Also emergency vehicles currently rely on vehicle horn, sirens, and flashing lights to prevent accidental collisions with pedestrians or other vehicles at intersections. An intersection-based system that would be activated remotely (and autonomously) by an approaching emergency vehicle is needed. Such a system overcomes some of these drawbacks of available systems by including an audible warning, most likely instructing nearby pedestrians to clear the intersection.

Visual displays at intersections may provide warnings to motorists and pedestrians yet they may fail to get the attention of pedestrian standing near an intersection. A visual sign may be barely visible at significant viewing angles and pedestrians will likely not be looking in the direction of any sign. For this reason, audible alerts in addition to visual may be the most effective (and rapid) warning system of the approach of emergency vehicles.

There is also the difficulty that pedestrians may often be in harms way if they fail to hear an approaching emergency vehicle. Although vehicle sirens are especially loud, many circumstances can lead to dangerous situations and potential injury. For instance, an especially long crosswalk may take up to 20 seconds to cross. In that time, an emergency vehicle may be heard, perhaps stranding the pedestrian in the middle of a crosswalk. Likewise, in extremely busy metropolitan intersections, ambient noise in the building occlusions may prevent warning of the emergency vehicle until just seconds before the vehicle arrived at an intersection. Previous experience with visual warning systems show that pedestrians are often unable to see the visual warning signs sufficiently during demonstrations.

It is one object of the present invention to provide an emergency vehicle traffic signal preemption system that is fully autonomous and not dependent on the intersection being in visual range.

Still another object of the present invention is to provide an emergency vehicle traffic signal preemption system that provides conflict detection and alerts other emergency vehicles in the area.

Still another object of the present invention is to provide an emergency vehicle traffic signal preemption system that includes a real-time monitor of intersection phase.

Yet another object of the present invention is to provide an emergency vehicle preemption system having an emergency vehicle transponder including an on-board diagnostic interface, a navigation interface, and a communications monitor and control interface.

Still another object of the present invention is to provide an improved emergency vehicle traffic signal preemption system including a real-time intersection status monitor.

Still another object of the present invention is to provide an emergency vehicle traffic signal preemption system that includes a pedestrian audio warning signal to supplement the visual display and the audio signals from emergency vehicles.

BRIEF DESCRIPTION OF THE INVENTION

The purpose of the present invention is to provide an improved emergency vehicle traffic signal preemption system including autonomous operation, real-time phase monitoring and audio signals to alert pedestrians of the approach of emergency vehicles.

The system is fully autonomous and is not affected by range, weather, or line of sight. It provides real-time monitoring of the intersection phases to provide the visual display to alert motorist of oncoming emergency vehicle and the direction it is coming from. This system is an improvement for use with the system disclosed and described in U.S. Pat. No. 4,704,610 of Smith et al issued Nov. 3, 1987 and incorporated herein by reference. The system also provides an added feature of conflict indication to the emergency vehicle operator, indicating that another emergency vehicle is responding and is approaching the same intersection, indicating which vehicle has the preemption and right of way.

This system is unique in that it is fully autonomous and not dependent on the intersection being in visual range. It provides conflict detection and alerts other emergency vehicle operators in the area, has the ability to interrupt pedestrian access, stops preemption when an emergency vehicle stops, and provides interface to and control of the system disclosed and described in the above-identified patent.

The improved emergency vehicle traffic signal preemption system consists of three major subsystems. An intersection monitor and control, an emergency vehicle transponder and its interfaces, and a wide area communications network and its associated proprietary control program software. The emergency vehicle intersection preemption design connects intersections and vehicles over a two-way wide area wireless communications network. This network is synchronized via Global Positioning System (GPS) timing signals.

When an emergency vehicle operator receives an emergency response request, the vehicle is placed in a Code 3 mode with lights and sirens operating, at the same moment the vehicle preemption transponder reads the vehicle on-board diagnostics (OBD) data and determines speed and acceleration, and gathers navigation data from one of several navigation systems. This data is collected by an on-board microprocessor that processes this information, determines heading and position, which is then formatted, the vehicle identification (ID) added, and the data is then transmitted to various intersections within the design area of coverage.

The intersection processor receives the data, identifies the vehicle time of arrival, compares it with other vehicles approaching an intersection, and determines which vehicle will arrive first, and sends notification to all approaching emergency vehicles that there is a conflict and identifies for an operator which vehicle has the right of way.

Simultaneously the processor collects real-time intersection base monitor output and calculates when preemption should start, and when to inhibit pedestrian crossing access. When preemption starts, a visual display is sent coded commands via a wireless connection to light the proper icons for each direction showing emergency vehicle approach, direction, and lighting emergency vehicle approach message. All this takes place in real time and in a manner appropriate to insure an intersection is preempted early enough to assure a safe and clear path for an emergency vehicle.

The system disclosed herein provides a number of improvements of the above-identified patent. It is an autonomous system that does not need involvement of emergency vehicle operator. It also includes expanded system capabilities using emergency vehicle on-board diagnostics (OBD), monitoring multiple emergency vehicles approaching the same intersection using Global Positioning System (GPS), and speed and heading information for multiple emergency vehicles to determine the right of way. An intersection status is transmitted to emergency vehicle dashboards indicating when the intersection is safe to traverse. A dashboard display indicates to the vehicle operator the status of an intersection. The system also includes a wide area wireless RF communication links between emergency vehicles and intersections. This system is reliable and unaffected by weather, rain, or lack of line of sight.

The system includes real-time monitoring of all intersection traffic lights by a fail-safe, isolated, high impedance tap and subsequent digital circuit processing to provide intersection status to each emergency vehicle. Simultaneously, pedestrian audio alerts are activated when emergency vehicles are approaching an intersection. These are important because often visual signs at an intersection may not be clearly visible to a pedestrian. Beepers, bells, sirens, or even spoken instructions at high volume can be used.

Several types of emergency vehicle location and navigation information retrieval are possible. Among these are Global Positioning Systems (GPS), dead reckoning, beacon triangulation, tags, traffic loop, RDIF, etc. Each vehicle has an identification (ID) that allows transmission to the appropriate vehicle that it has the right-of-way to a preempted intersection.

The improvements to the existing system in the above-identified patent are to enhance the performance but the purpose of the system remains the same. That is, to alert and stop vehicles and pedestrians from using an intersection to allow an emergency vehicle to pass safely. Some prior warning is necessary to allow clearing the intersection. The previous implementation uses a one-way infrared link to transmit approach and departure information of emergency vehicle to the intersection which is equipped with four emergency vehicle status display panels mounted next to the usual traffic lights at each intersection.

The system transmits a signal causing all traffic lights at an intersection to switch to "red" thus stopping all traffic in all directions. In addition, the display panels flash a relatively large "emergency vehicle" therein with a graphic display indicating the lane and direction of traffic taken by an emergency vehicle. The range of the infrared transmitter can be as much as 1,000 feet allowing sufficient time to clear the intersection. The new improved system utilizes a wide area wireless RF two-way communication link between emergency vehicles and intersections. This method is more reliable and not affected by weather, lack of line of sight, range limitation or obstructions.

Another advantage of the two-way wireless RF communications link between the intersections and emergency vehicles is the ability to display much more useful data in the vehicles helping the vehicle operator maneuver his vehicle most efficiently and safely. Intersection status shows when an intersection has been preempted allowing safe passage. If more than one emergency vehicle approaches an intersection, the system determines which vehicle should have the right of way depending on location information (GPS, traffic loop, beacon, etc.), direction and speed sent to the intersection control. A proprietary control program determines the right of way and sends the result to emergency vehicles. The data package transmitted over transceivers are tagged with the vehicle ID to insure proper utilization.

Another improvement to the system is an audio warning system intended to alert pedestrians that an intersection has been preempted and must be kept clear. One desirable implementation would utilize loudspeakers mounted near the four corners of the intersection where pedestrians normally gather to cross. A spoken message such as "Warning! Emergency Vehicle Approaching. Do Not Walk." may be most preferred but any audible signal such as a wailing sound, a siren, or any other familiar emergency sound may be utilized. The activation signal is issued by yet another feature of the improved implementation which is the real-time monitoring of all traffic lights at the intersection with fail-safe, high impedance taps and subsequent digital processing to generate a preemptive status signal that is then transmitted to the emergency vehicles. This feature assures that the preemption command has been executed.

Another goal of the improved system is creation of an autonomous system that is activated by reception of a Code 3 status or alarm. The operator of the emergency vehicle can concentrate on his primary duty which is to arrive at the sight of the emergency safely in the shortest time possible without worrying about the activation of the system. A Code 3 signal starts the process of communication between an intersection that is being approached and the emergency vehicle and the system performs the functions described above.

The information available from the emergency vehicle and intersection controllers may be transmitted to a central location such as a dispatch center or traffic control center to display the status of multiplicity of intersections and emergency vehicles. Such information being displayed on a status board can be invaluable in managing emergency situations in a more sufficient manner because it makes available information on a real-time basis for the officials in charge.

The above and other objects, advantages, and novel features of the invention will be more fully understood from the following detailed description and the accompanying drawings, in which:

DETAILED DESCRIPTION OF THE INVENTION

Figure 1:
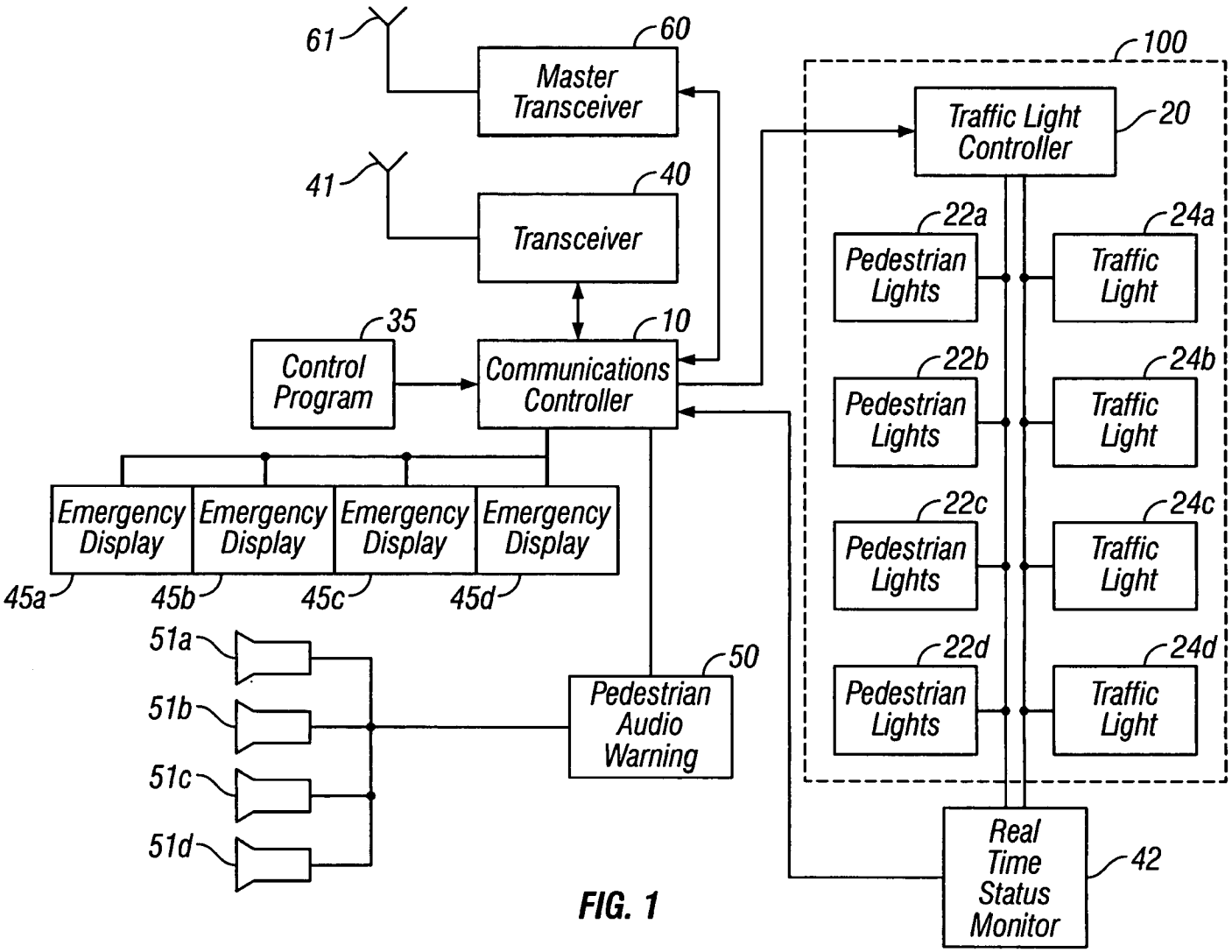
FIG. 1 is a block diagram of intersection functions for an emergency vehicle signal preemption system.
Figure 2:
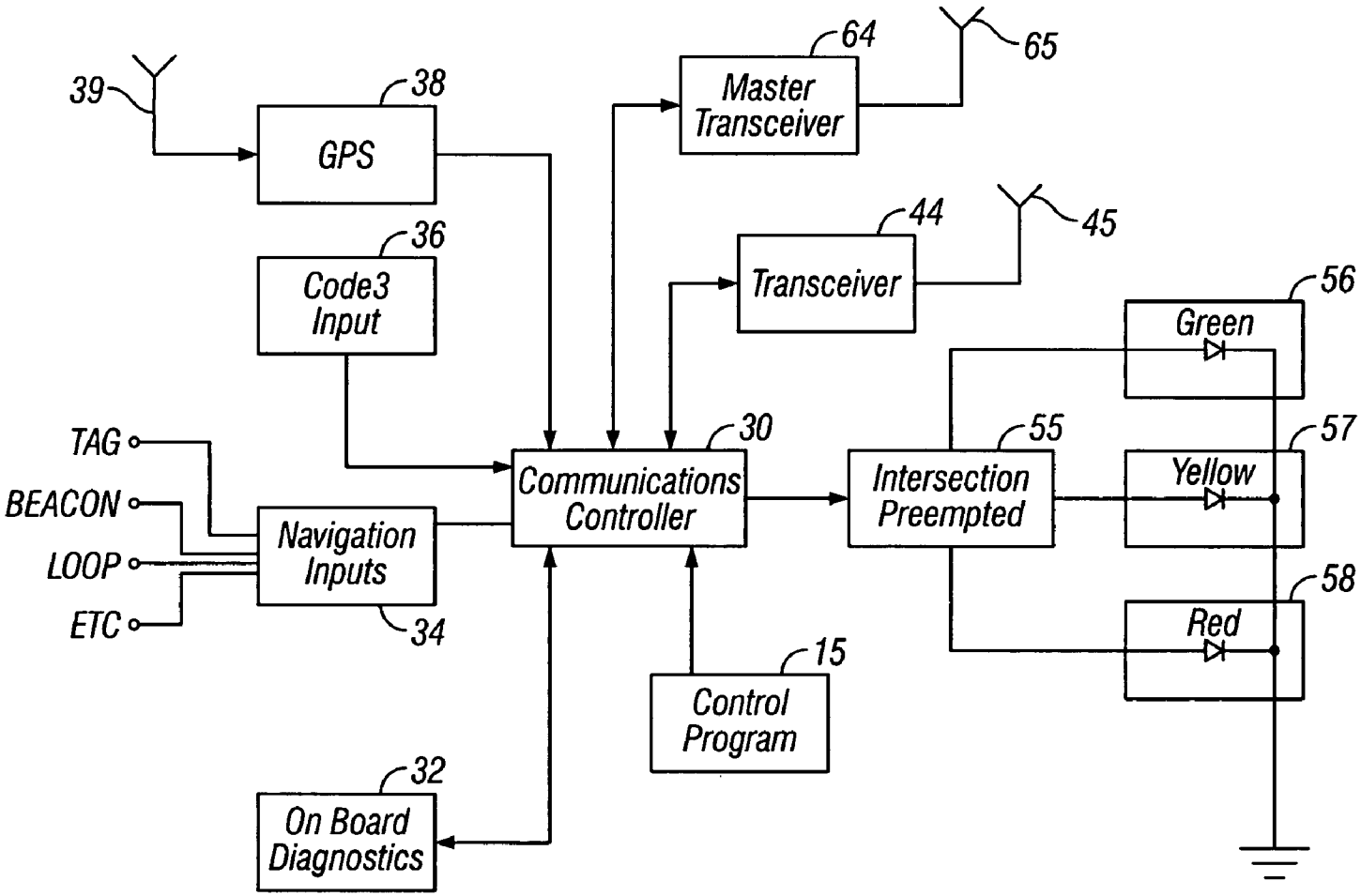
FIG. 2 is a block diagram of the functions in an emergency vehicle for the emergency vehicle signal preemption system.

The details of the emergency vehicle traffic signal preemption system are illustrated in the block diagrams of FIGS. 1 and 2. FIG. 1 illustrates the functional details of the system at each intersection while FIG. 2 illustrates the functions of the system installed in an emergency vehicle.

Traffic light control system 100 at an intersection includes traffic light controller 20 that generates the appropriate sequence of on-time and off-time for the various traffic lights that controls vehicular and pedestrian traffic at an intersection. Traffic light controller 20 also has the capability to be forced by external signals into a mode that activates all "red" lights simultaneously to close the intersection allowing safe passage for emergency vehicles. Controller 20 is preferably a microprocessing circuit driving isolated lamp drivers but discrete designs are also feasible. Some intersections may be more complicated, controlling turn lanes with arrow lights, but the basic principles remain the same.

An example of an intersection being controlled by the system and functions disclosed and describe herein is shown in FIG. 1 of U.S. Pat. No. 4,704,610 referred to hereinabove and incorporated herein by reference. This figure shows the signage and approach of emergency vehicles being controlled. The only feature missing is the pedestrian control signs at each corner which are an added feature of the invention disclosed and described herein.

Traffic light controller 20 generates signals to control pedestrian lights 22*a*, 22*b*, 22*c*, and 22*d* and also controls the operation of traffic lights 24*a*, 24*b*, 24*c*, and 24*d*. An intersection having traffic lights can be connected to a system using the emergency vehicle preemption system by addition of the functions described hereinafter without the need to rebuild an existing installation.

The heart of the additional equipment is the communications controller 10, a microprocessor (e.g., a Zworld LP 3100 CPU) operated by proprietary control program software 35. Controller 10 receives information from emergency vehicles that approach an intersection via wireless RF transceiver 40 and antenna 41. This information contains data about the position and heading of the emergency vehicle and that it is in a Code 3 alarm mode 36 thus requesting preemption of the intersection.

Communications controller 10 sends a command to controller 20 of the traffic light control system 100 forcing all "red" lights to come on stopping all traffic through the intersection. That means traffic lights 24*a* through 24*d* are all changed to "red" while pedestrian lights 22*a* through 22*d* are changed to stop pedestrian traffic.

Real-time status monitor 42 is unique because it verifies that all "red" lights are activated and sends a "intersection preempted" signal to communications controller 10. That is, real-time status monitor receives (i.e., "reads") the output from traffic light controller 20 and pedestrian lights 22*a* through 22*d* and traffic lights 24*a* through 24*d* and transmits that information to communications controller 10. Communications controller 10 in turn relays that information to emergency vehicles via wireless RF transceiver 40 and antenna 41. Communications controller 10 now sends signals to emergency display panels 45*a*, 45*b*, 45*c*, and 45*d* to light and flash large emergency signs with the proper icons at each corner of an intersection showing the position of any approaching emergency vehicle relative to the traffic lanes of the intersection as shown and described in the above-identified U.S. patent incorporated herein.

The display panels 45*a*–45*d* and proper icons used at each corner of an intersection are shown in FIG. 2 of the U.S. patent referenced hereinabove. The signage is also illustrated in U.S. Design Pat. No. 305,673, issued Jan. 23, 1990, also incorporated herein by reference.

Another improvement to the system is the provision of an audio warning to pedestrians. This is preferred because pedestrians may often be put in harms way if they fail to hear an approaching emergency vehicle. Although vehicle sirens are especially loud, many circumstances can lead to potential injury. For example, a long crosswalk may leave a pedestrian stranded when an emergency vehicle is approaching or in busy metropolitan areas, ambient noise in building occlusions may prevent a pedestrian from hearing the approach of an emergency vehicle early enough. Further, experience with visual warning systems indicates that pedestrians are often unable to see the visual warning signs they may not be at the correct viewing angle. Thus simultaneously with controlling the lights and pedestrian flashing signals, controller 10 generates an audio message to be delivered from audio warning device 50 to speakers 51*a* through 51*d*. Also, real-time status monitor provides information about the intersection to communications controller which is then transmitted via RF master transceiver 60 and antenna 61 to a central monitoring system such as a dispatcher's office.

The details of the software in the control program for implementing the functions of the system are not necessary because the functions controlled are described in great detail. Therefore many software solutions to implement the functions will be apparent to those skilled in the art.

Emergency vehicle functions for the preemption system are illustrated in the schematic block diagram of FIG. 2. A transponder is installed in each emergency vehicle and provides the functions that facilitates communication with preemptable intersections, and other emergency vehicles also central monitoring stations such as a dispatching center. Inputs and outputs to and from the emergency vehicle system are handled by communications controller 30 under the direction of proprietary control program software 15. Vehicle parameters are determined from several inputs provided to communications controller 30.

Vehicle position is available from GPS receiver 38 via antenna 39. Several positioning inputs are available from ports in navigation input device 34. Optional alternative inputs from ports and navigation input device 34 are tag, beacon, loop, etc. Vehicle information such as speed and acceleration are provided by on-board diagnostic (OBD) board 32 that generates the proper digital signals which are input to communications controller 30.

The emergency vehicle transponder system communicates with intersections via wireless RF transceiver 44 and antenna 45. It receives "intersection preempted" verification and displays the information on-board by activating one or more LEDs 56, 57, or 58. If it receives a signal for safe passage through an intersection, "green" LED 56 is illuminated. If another emergency vehicle has the right of way at an intersection, "yellow" LED 57 is illuminated. With "yellow" LED 57 illuminated, the emergency vehicle is notified that another emergency vehicle is approaching and has the right of way.

Illumination of "red" LED 58 indicates that there is no preemption at the intersection. LEDs 56 through 58 are driven by "intersection preempted" logic circuit 55.

Emergency vehicle status is available in real time via master RF transceiver 64 and antenna 65 to a central monitoring station. Thus the position of any vehicle as well as the status at an intersection is always available at some centrally located dispatch station.

As indicated previously, the software in control program 15 to implement the functions of the transponder described above has many possible solutions. Thus the software provided to control the operation of communications controller 30 can be designed and implemented by anyone skilled in the art given the detailed explanation of the system and functions described hereinabove.

Figure 3:
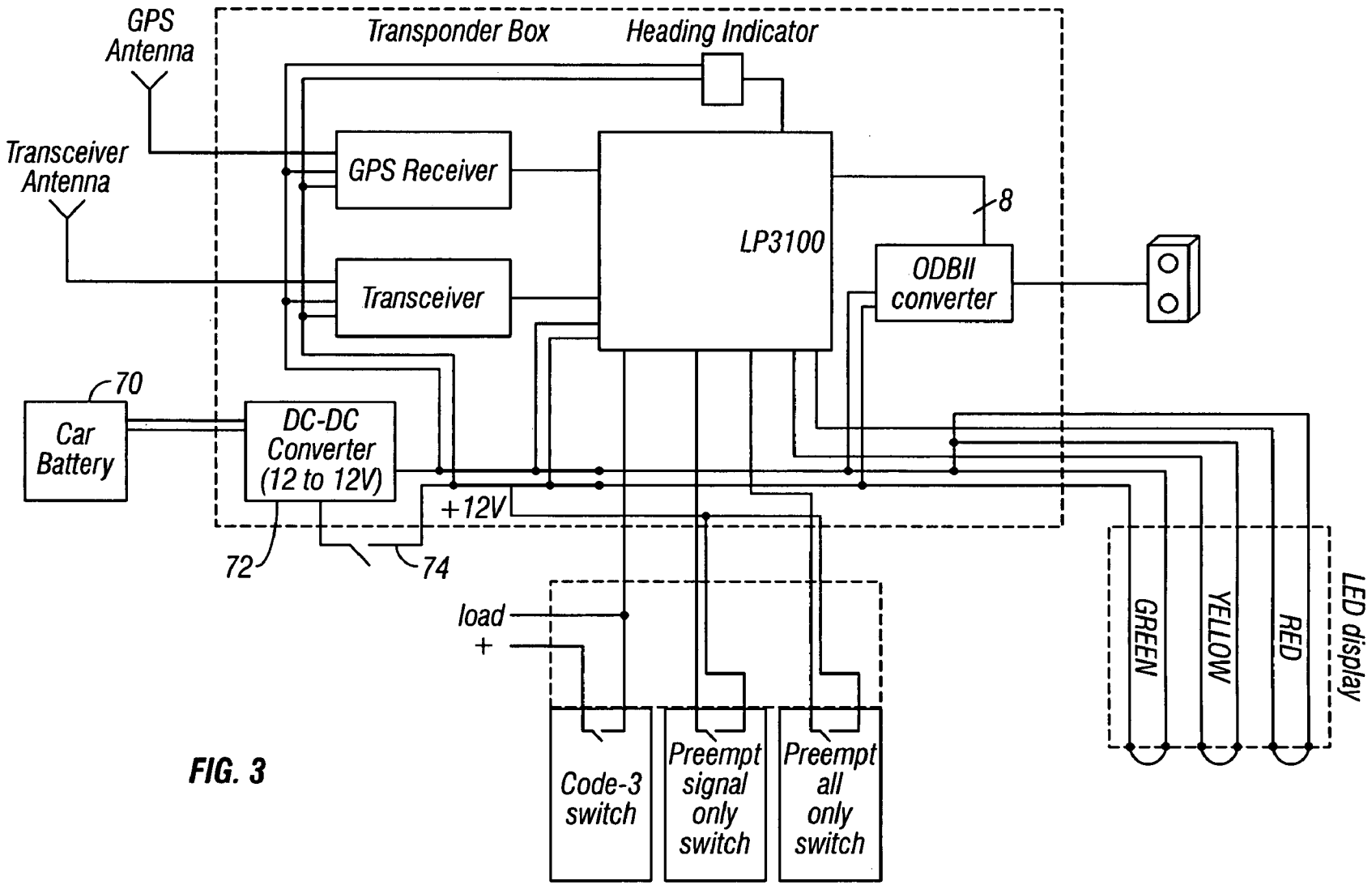
FIG. 3 is an example of a schematic block diagram of a transponder use in emergency vehicles.

FIG. 3 is a schematic block diagram of the transponder system mounted in each vehicle. The transponder box in the vehicle receives power from car battery 70 input to a DC to DC converter 72 activated by master power switch 74. The transponder box has a GPS receiver such as that produced and manufactured by Garmin International Incorporated. The transceiver can be a radio transceiver produced and manufactured by Freewave Technologies of Boulder, Colo.

Figure 4:
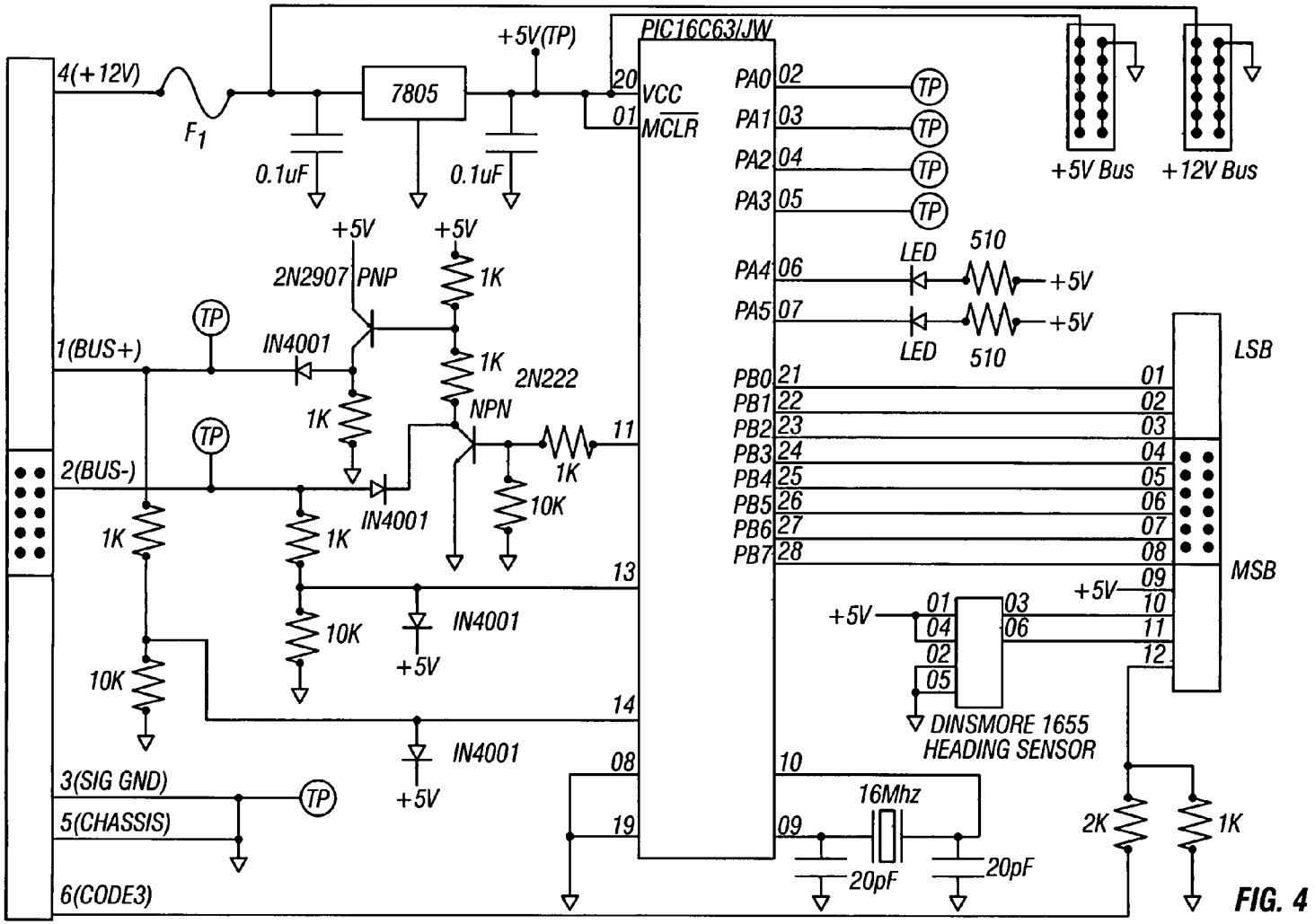
FIG. 4 is an example of a schematic diagram of on-board diagnostic electronics for the emergency vehicle signal preemption system.

FIG. 4 is a schematic diagram of the on-board diagnostic circuit for the in-vehicle electronics and transponder. The on-board diagnostic circuit handles such information as speed, acceleration, heading, etc. and generates the proper digital signal delivered to communications controller 30.

Thus there has been disclosed improvements to an emergency vehicle traffic signal preemption system. Improvements include providing an autonomous system that is not dependent on intersection being in visual range. The system provides conflict detection and alerts emergency vehicle operators in the area, and provides real-time monitoring of an intersection phase. The real-time monitoring of intersections is indicated by LEDs on a transponder in the emergency vehicle that show whether there is a conflict or the intersection being approached is not preempted. The system also includes the improvement of an audio alarm to alert pedestrians who may not be aware of an approaching emergency vehicle for various reasons or are at an angle where visible signs are not clear.

This invention is not to be limited by the embodiment shown in the drawings and described in the description which is given by way of example and not of limitation, but only in accordance with the scope of the appended claims.

What is claimed is:

1. An emergency vehicle traffic signal preemption system;

an intersection communications controller at each intersection for preemption;

a traffic light controller receiving inputs from said communications controller to control the operation of traffic lights and pedestrian lights at an intersection;

a transceiver for receiving information from an emergency vehicle and transmitting information about the status of an intersection;

a real-time status monitor for monitoring status at a selected intersection and verifying preemption of the intersection, said status monitor relaying said status information at said intersection to said communications controller;

a transponder in each emergency vehicle receiving said status information being transmitted by said intersection transceiver, said transponder including a transceiver for transmitting emergency vehicle data to said intersection communications controller;

a display in said emergency vehicle displaying the status of said intersection and other emergency vehicles responding to an emergency;

whereby said emergency vehicle traffic signal preemption system operates autonomously by transmissions to and from said emergency vehicle and intersection.

2. The system according to claim 1 in which said intersection communications controller controls the operation of a display at each corner of an intersection to indicate the direction and location of one or more emergency vehicles approaching an intersection.

3. The system according to claim 2 in which said status monitor is a real-time status monitor.

4. The system according to claim 1 including an audio warning system to alert pedestrians at said intersection.

5. The system according to claim 4 in which said audio warning system includes an audio warning circuit receiving an output from said intersection communications controller, said audio warning circuit activating an audio warning device at said intersection.

6. The system according to claim 5 in which said audio warning device comprises a speaker at each corner of an intersection.

7. The system according to claim 1 in which said transponder includes;

a transponder communications controller;

an on-board diagnostic circuit, said on-board diagnostic circuit processes data regarding an emergency vehicle and delivering said data to said transponder communications controller;

a transceiver in said transponder transmitting said data from said on-board diagnostic circuit to said intersection.

8. The system according to claim 7 in which said transponder transceiver receives status information regarding said intersection;

said intersection status information being delivered to an intersection preemption circuit;

said intersection preemption circuit activating said display in said transponder to indicate the status intersection.

9. The system according to claim 8 in which said display includes colored LEDs to indicate the status of an intersection.

10. The system according to claim 9 in which said colored LEDs are a green LED, a yellow LED and a red LED, said green, yellow, and red LEDs selectively indicating preemption detected, preemption active or a conflict with another approaching emergency vehicle detected respectively.

11. An emergency vehicle traffic signal preemption and control method comprising;

receiving emergency vehicle critical data at an intersection transceiver;

processing said emergency vehicle critical data in an intersection digital communication controller;

activating a traffic light controller by an output from said communications controller;

activating all traffic and pedestrian lights at an intersection to stop all vehicle and pedestrian traffic at said intersection;

monitoring the status of said traffic light controller, traffic lights and pedestrian lights at said intersection;

verifying preemption of the intersection;

transmitting said status information monitored to said emergency vehicle;

displaying the status of said intersection and other emergency vehicles in said emergency vehicle;

whereby said emergency vehicle traffic light preemption method operates to control the flow of vehicle and pedestrian traffic at an intersection autonomously to allow safe passage of emergency vehicles.

12. The method according to claim 11 including;

collecting critical data about said emergency vehicle in an on-board diagnostic circuit;

processing said critical data in a vehicle digital communications controller;

transmitting said emergency vehicle critical data to said transceiver at said intersection.

13. The method according to claim 11 including;

activating an audio alarm at said intersection to alert pedestrians of the approach of an emergency vehicle.

14. The method according to claim 13 in which said activation of said audio alarm comprises activating an audio alarm circuit to transmit a predetermined audio communications.

15. The method according to claim 14 in which said transmission of said audio communication comprises transmitting said audio communication to a loud speaker at each corner of said intersection.

16. The method according to claim 11 in which said step of displaying information about the status of an intersection in said emergency vehicle comprises activating one of a plurality of colored LEDs.

17. The method according to claim 16 in which said activating one of a plurality of LEDs comprises activating a red LED to indicate a conflict with another emergency vehicle approaching an intersection; activating a yellow LED to indicate said intersection is preempted or activating a green LED to indicate preemption of said intersection is detected.

* * * * *